US011844965B2

(12) United States Patent
Yan

(10) Patent No.: US 11,844,965 B2
(45) Date of Patent: Dec. 19, 2023

(54) RAIL TYPE ANTI-FALLING SAFETY DEVICE

(71) Applicant: JIANGNAN UNIVERSITY, Wuxi (CN)

(72) Inventor: Wenxu Yan, Wuxi (CN)

(73) Assignee: JIANGNAN UNIVERSITY, Jiangsu (CN)

( * ) Notice: Subject to any disclaimer, the term of this patent is extended or adjusted under 35 U.S.C. 154(b) by 757 days.

(21) Appl. No.: 16/964,552

(22) PCT Filed: Mar. 18, 2019

(86) PCT No.: PCT/CN2019/078447

§ 371 (c)(1),
(2) Date: Jul. 23, 2020

(87) PCT Pub. No.: WO2020/181567

PCT Pub. Date: Sep. 17, 2020

(65) Prior Publication Data

US 2021/0361987 A1 Nov. 25, 2021

(30) Foreign Application Priority Data

Mar. 8, 2019 (CN) ..... 201910176239.7

(51) Int. Cl.
*A62B 35/00* (2006.01)

(52) U.S. Cl.
CPC ..... *A62B 35/0081* (2013.01); *A62B 35/0062* (2013.01)

(58) Field of Classification Search
CPC ..... A62B 35/0081; A62B 1/10; E06C 7/187
See application file for complete search history.

(56) References Cited

U.S. PATENT DOCUMENTS 5,323,873 A 6/1994 Pelofi
8,584,797 B2 * 11/2013 Krauss ..... E06C 7/187 182/36

(Continued)

FOREIGN PATENT DOCUMENTS

CN 201135722 Y 10/2008
CN 101537239 A 9/2009

(Continued)

*Primary Examiner* — Jessica L Laux
*Assistant Examiner* — Kathleen M. McFarland
(74) *Attorney, Agent, or Firm* — SZDC Law PC

(57) ABSTRACT

The invention discloses a rail type anti-falling safety device including a primary bearing block, an anti-falling tongue through-groove is opened on an upper end face of the primary bearing block, an anti-falling tongue pin is provided in the through-groove, an anti-falling tongue is provided on and rotatable about the anti-falling tongue pin, the anti-falling tongue is pressed tightly against a T-shaped steel-rail surface under the action of an elastic element, the anti-falling tongue has a cam structure at the end pressed against the T-shaped steel rail surface and a hanging loop at the end far from the end pressed against the T-shaped steel rail surface. A first clamping block is provided on a lower end face of the primary bearing block. The invention allows adjustments to the groove width of the anti-falling device while the safety and reliability is ensured, thereby providing uninterrupted personal safety guarantee for the worker.

5 Claims, 5 Drawing Sheets

(56) References Cited

U.S. PATENT DOCUMENTS

| | | | | |
|---|---|---|---|---|
| 9,132,297 | B2 * | 9/2015 | Casebolt | F16B 2/18 |
| 11,052,270 | B2 * | 7/2021 | Voss | E06C 7/187 |
| 2010/0012424 | A1 * | 1/2010 | Krauss | A62B 35/04 182/3 |
| 2010/0032239 | A1 * | 2/2010 | Rinklake | E06C 7/186 188/65.1 |
| 2015/0129357 | A1 * | 5/2015 | Roth | A62B 35/0093 182/5 |
| 2019/0282842 | A1 * | 9/2019 | Voss | E06C 7/187 |

FOREIGN PATENT DOCUMENTS

| | | | |
|---|---|---|---|
| CN | 103656914 | A | 3/2014 |
| CN | 204182046 | U | 3/2015 |
| CN | 204337548 | U | 5/2015 |
| CN | 101559267 | A | 10/2019 |
| FR | 2617050 | A1 | 12/1988 |

* cited by examiner

RAIL TYPE ANTI-FALLING SAFETY DEVICE

This application is the National Stage Application of PCT/CN2019/078447, filed on Mar. 18, 2019, which claims priority to Chinese Patent Application No.: 201910176239.7, Mar. 8, 2019, which is incorporated by reference for all purposes as if fully set forth herein.

FIELD OF THE INVENTION

The present invention relates to the field of aerial work protection, and more particularly to a rail type anti-falling safety device.

DESCRIPTION OF THE RELATED ART

In aerial work, it is critically important to prevent workers from high falling. For this purpose, anti-falling devices have been developed.

In conventional art, there are technical problems as follows.

There are mainly two types of anti-falling devices on the market. One type is an anti-falling device having a fixed groove width (as in CN204182046U, titled STEEL RAIL ANTI-FALLING DEVICE and CN204337548U, titled STEEL RAIL ANTI-FALLING DEVICE FOR ANTI-FALLING IN AERIAL WORK). This type of device has a disadvantage that due to the dimensional deviation at the abutting joint of the rail, the anti-falling device having a fixed groove width is likely to be stuck at this abutting joint of the rail, thereby hindering the motion of the worker and consequently causing potential safety hazards as it is often abandoned by workers during operation. The other type is an anti-falling device having a variable groove width with a stopper pin. In this type of device, the stopper pin may be accidentally pulled off, causing the bearing block to be bounced off from the rail, thereby posing potential safety hazards.

SUMMARY OF THE INVENTION

A technical problem to be solved by the present invention is to provide a rail type anti-falling safety device, which allows adjustment to the groove width of the anti-falling device while the safety and reliability are ensured even during human adjustment to the groove width, thereby providing uninterrupted personal safety guarantee for the worker during operation.

For the above purpose, the present invention provides a rail type anti-falling safety device, which includes:

a primary bearing block, where an anti-falling tongue through-groove is opened on an upper end face of the primary bearing block, an anti-falling tongue pin is provided in the anti-falling tongue through-groove, an anti-falling tongue is provided on the anti-falling tongue pin and is rotatable about the anti-falling tongue pin, the anti-falling tongue is pressed tightly against a surface of a T-shaped steel rail under the action of an elastic element without an external force, the anti-falling tongue has a cam structure at the end pressed against the surface of the T-shaped steel rail and has a hanging loop at the end far from the end pressed against the surface of the T-shaped steel-rail; a first clamping block is provided on a lower end face of the primary bearing block, at least two first rolling wheels are provided on an inner wall of the first clamping block; at least one second rolling wheel is provided on the end face of the primary bearing block far from the anti-falling tongue; two guiding through-grooves are provided on a side wall of the primary bearing block; and a return spring fixture block is provided in the guiding through-groove;

a secondary bearing block, where a second clamping block is provided on an upper end face of the secondary bearing block, at least two third rolling wheels are provided on an inner wall of the second clamping block; two insertion arms are provided on a side wall of the secondary bearing block for inserting into the guiding through-groove; a return spring groove is opened on the insertion arm; a return spring is arranged in the return spring groove, one end of the return spring abuts against the return spring fixture block and the other end of the return spring abuts against the side wall of the return spring groove; a locking through-groove is opened at the free end of the insertion arm; and a locking assembly including two locking members, where the locking members each includes a stopper block and a press handle that are integrally formed and configured as L-shaped; the connection portion between the stopper block and the press handle is hinged to the free end of the insertion arm; the free end of the stopper block is beveled; the locking member further includes a locking spring, one end of the locking spring is arranged on the side wall of the locking through-groove and the other end of the locking spring is arranged on the abut block; the stopper block abuts against the primary bearing block under the action of the locking spring without an external force; the stopper block is located in the locking through-groove when the press handle is pressed;

wherein the first clamping block and the second clamping block clamp the T-shaped steel rail jointly.

As compared with the prior art, the present invention has the following beneficial effects.

The invention allows adjustment to the groove width of the anti-falling device while the safety and reliability are ensured even during human adjustment to the groove width, thereby providing uninterrupted personal safety guarantee for the worker during operation.

In an embodiment, the elastic element is a tension spring.

In an embodiment, the elastic element is a torsion spring through which the anti-falling tongue pin passes.

In an embodiment, the anti-falling tongue has knurling at the end pressed against the surface of the T-shaped steel rail.

In an embodiment, the cam structure is an involute cam structure.

In an embodiment, the press handles of the two locking members are brought into contact with each other under pressure.

DETAILED DESCRIPTION OF THE PREFERRED EMBODIMENTS

The present invention will be further described below with reference to the drawings and specific embodiments, so that those skilled in the art can better understand and implement the present invention, but the illustrated embodiments are not intended to limit the present invention.

Figure 1:
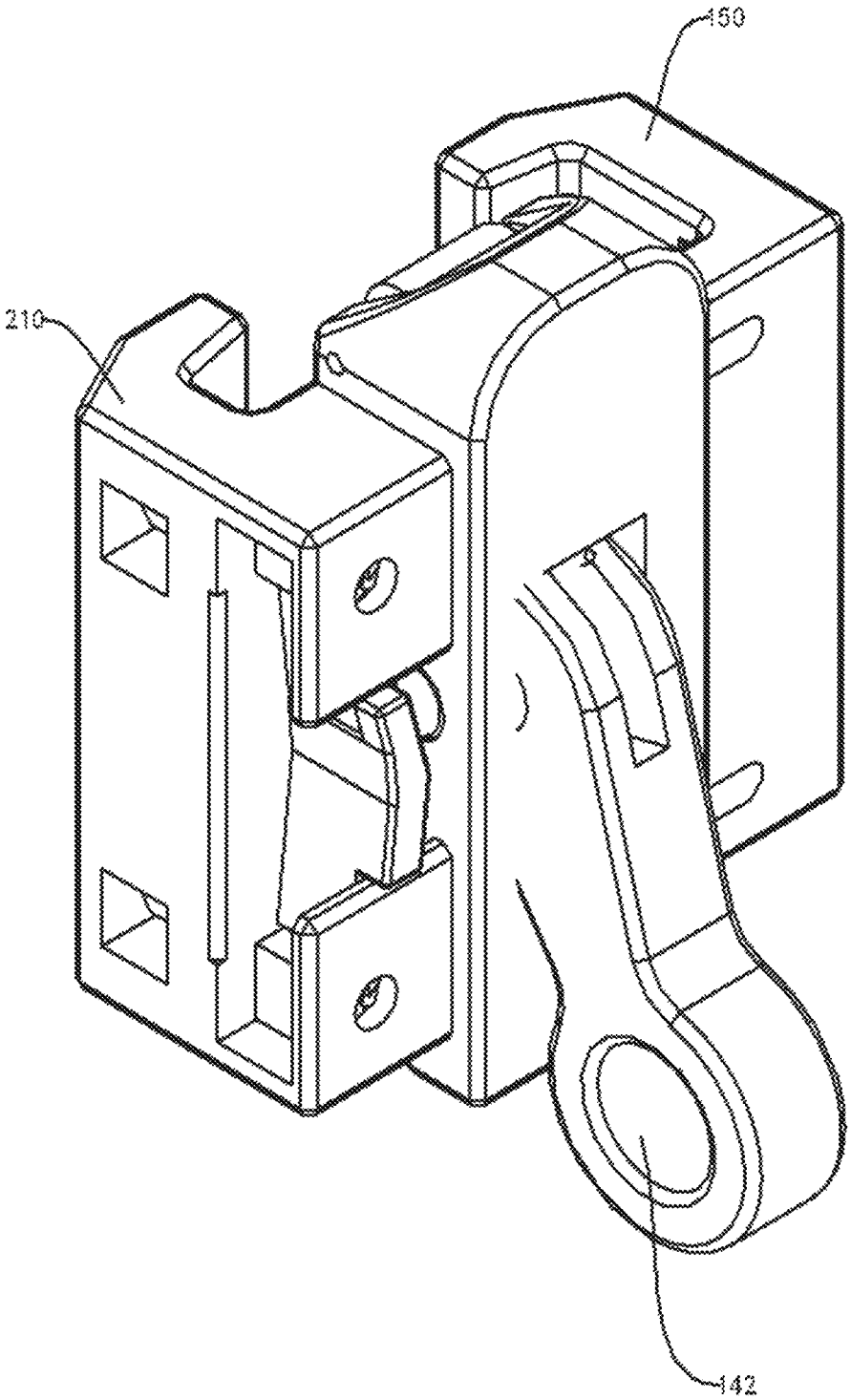
FIG. 1 is a schematic view of the overall structure of a rail type anti-falling safety device according to the present invention.
Figure 2:
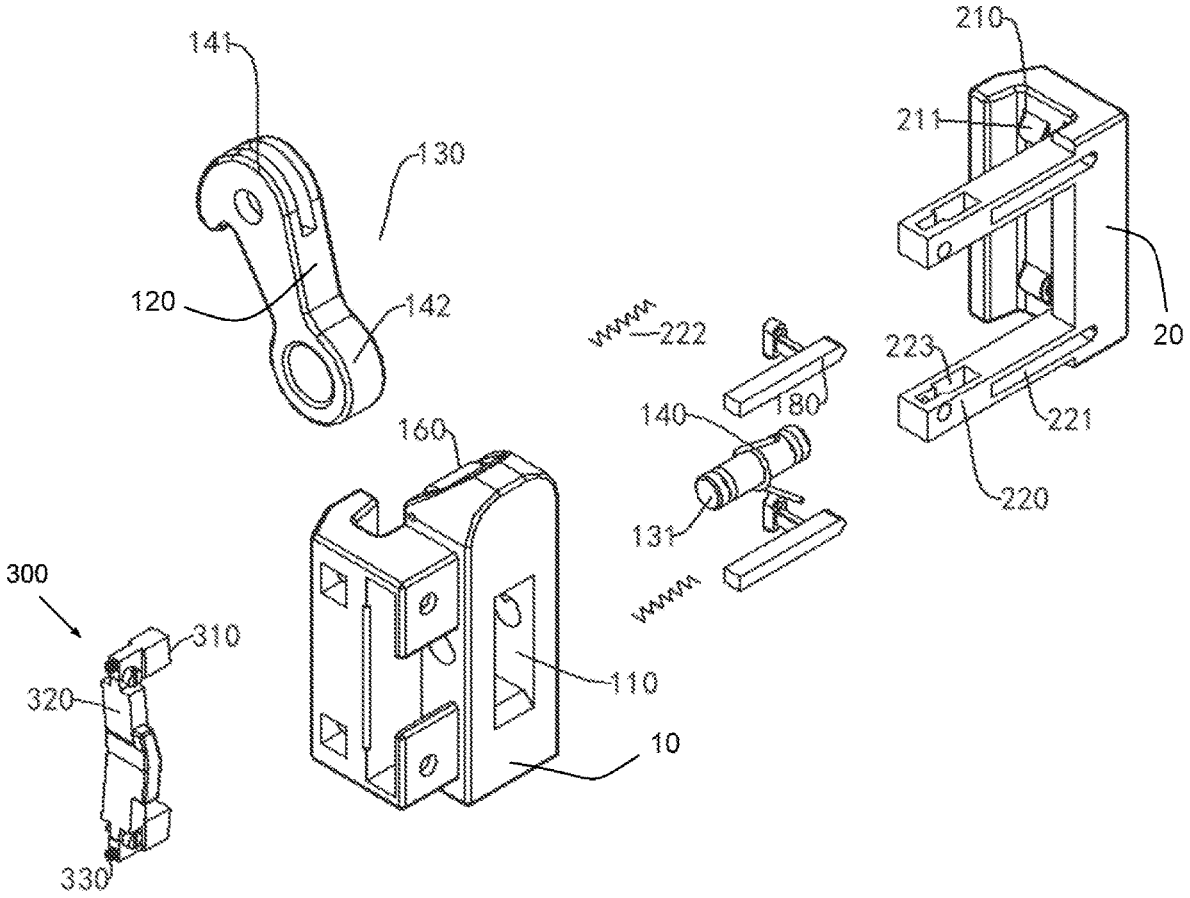
FIG. 2 is a schematic exploded view of a rail type anti-falling safety device according to the present invention.
Figure 3:
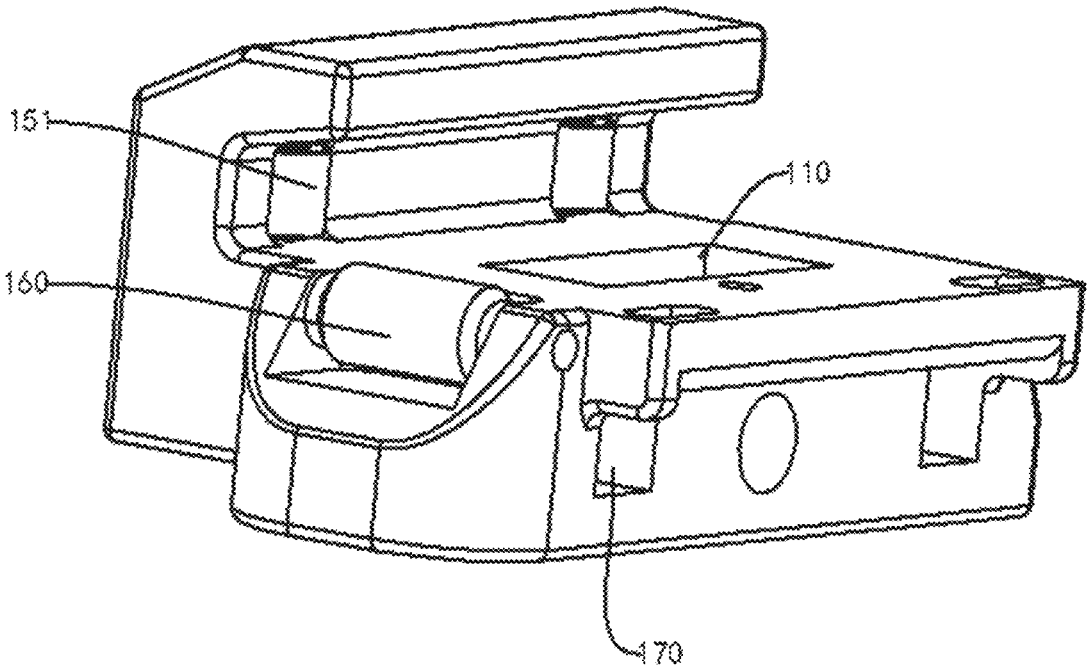
FIG. 3 is a schematic view of a primary bearing block of a rail type anti-falling safety device according to the present invention (only a part of the structure being shown)

Referring FIGS. 1 to 3, a rail type anti-falling safety device includes a primary bearing block 10, a secondary bearing block 20 and a locking assembly.

An anti-falling tongue through-groove 110 is opened on an upper end face of the primary bearing block, an anti-falling tongue pin 120 is provided in the anti-falling tongue through-groove, an anti-falling tongue 130 is provided on the anti-falling tongue pin. The anti-falling tongue is rotatable about the anti-falling tongue pin 120 and the anti-falling tongue is pressed tightly against a surface of a T-shaped steel rail under the action of an elastic element 140 without an external force The anti-falling tongue has a cam structure 141 at the end pressed against the surface of the T-shaped steel rail and has a hanging loop 142 at the end far from the end pressed against the surface of the T-shaped steel-rail. A first clamping block 150 is provided on a lower end face of the primary bearing block, at least two first rolling wheels 151 are provided on an inner wall of the first clamping block. At least one second rolling wheel 160 is provided on the end face of the primary bearing block far from the anti-falling tongue. Two guiding through-grooves 170 are opened on a side wall of the primary bearing block, and a return spring fixture block 180 is arranged in the guiding through-groove;

A second clamping block 210 is provided on an upper end face of the secondary bearing block, at least two third rolling wheels 211 are provided on an inner wall of the second clamping block. Two insertion arms 220 are provided on a side wall of the secondary bearing block, and the insertion arms are inserted into the guiding through-grooves. A return spring groove 221 is opened on the insertion arm, a return spring 222 is provided in the return spring groove, one end of the return spring abuts against the return spring fixture block and the other end of the return spring abuts against the side wall of the return spring groove. A locking through-groove 223 is opened at the free end of the insertion arm.

The locking assembly includes two locking members 300, each of the locking members 300 includes a stopper block 310 and a press handle 320 that are integrally formed, and the stopper block and the press handle are configured as L-shaped. The connection portion between the stopper block and the press handle is hinged to the free end of the insertion arm. The free end of the stopper block is beveled. The locking member further includes a locking spring 330, one end of the locking spring is arranged on the side wall of the locking through-groove and the other end of the locking spring is arranged on the abut block. The stopper block abuts against the primary bearing block under the action of the locking spring without an external force, and the stopper block is placed in the locking through-groove when the press handle is pressed;

The first clamping block and the second clamping block clamp the T-shaped steel rail jointly.

The present invention has the following beneficial effects.

Figure 4:
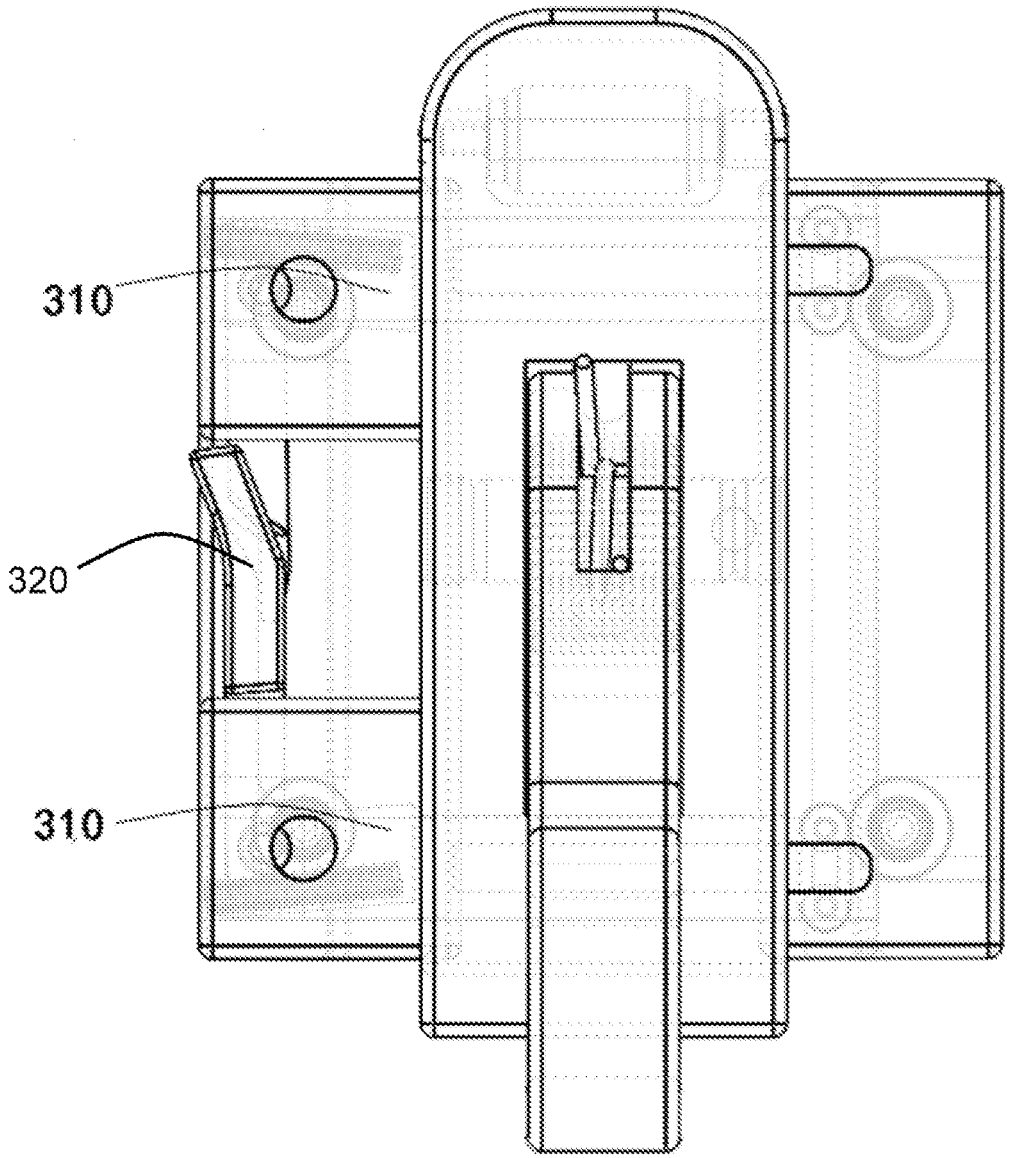
FIG. 4 is a schematic view of a rail type anti-falling safety device according to the present invention in a locked state.
Figure 5:
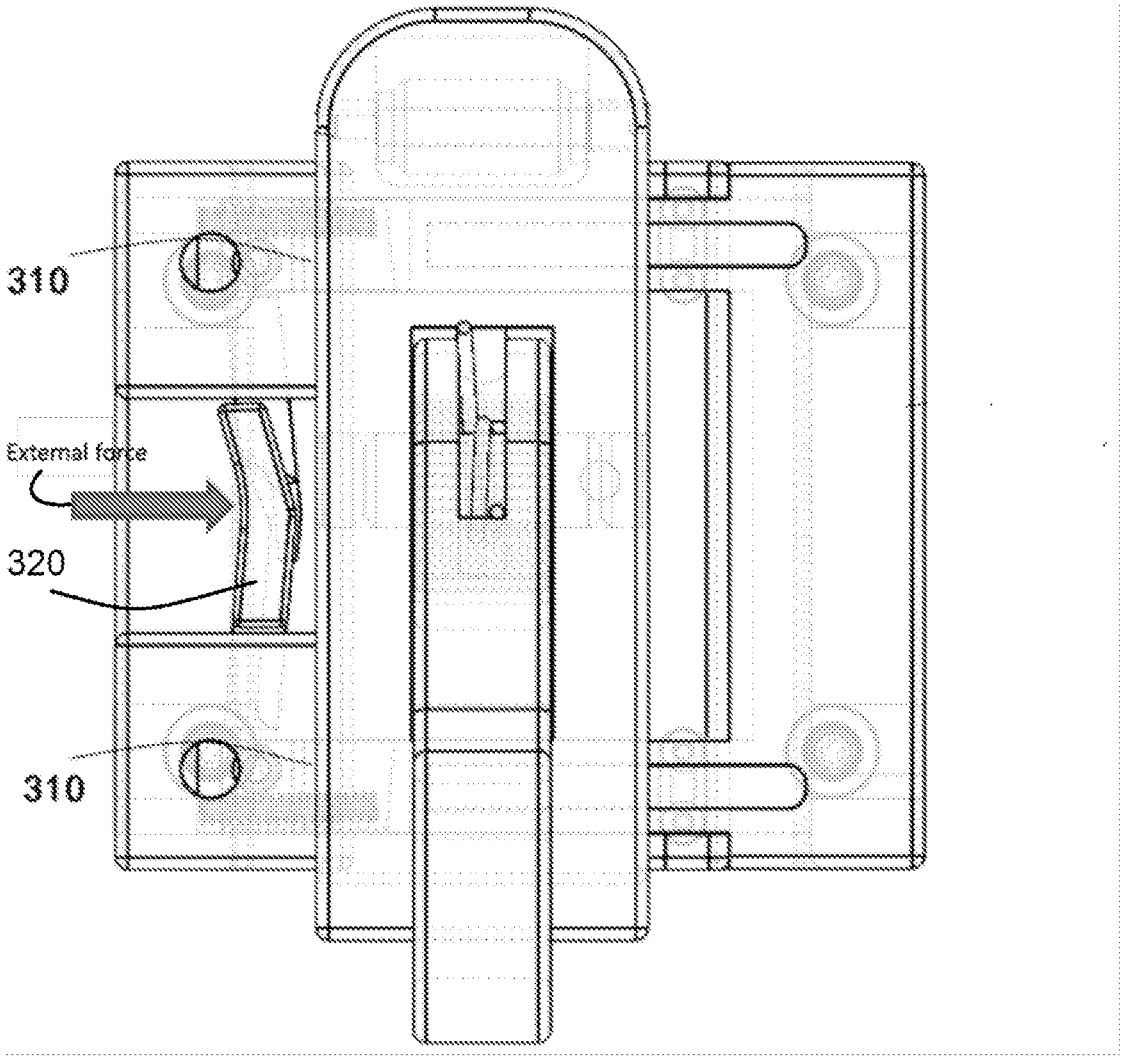
FIG. 5 is a schematic view of a rail type anti-falling safety device according to the present invention in an unlocked state.

In the invention, the anti-falling safety device allows adjustment to the groove width while the safety and reliability are ensured even during human adjustment to the groove width, thereby providing uninterrupted personal safety guarantee for the worker during operation. Referring to FIGS. 4 to 5, specifically, when a force is exerted on the press handle, the locking member is rotated and the stopper block is placed into the locking through-groove, meanwhile, the width between the secondary bearing block and the primary bearing block is increased, thereby achieving unlocking. When no force is exerted on the press handle, the width between the secondary bearing block and the primary bearing block is gradually returned under the action of the return spring. When the stopper block is not in the guiding through-groove, the width between the secondary bearing block and the primary bearing block is returned, then the stopper block abuts against the primary bearing block under the action of the locking spring, thereby achieving locking.

In an embodiment, the elastic element is a tension spring.

In an embodiment, the elastic element is a torsion spring through which the anti-falling tongue pin passes.

For particular implementation of the tension spring, reference may be made to CN204337548U, titled STEEL-RAIL ANTI-FALLING DEVICE FOR ANTI-FALLING IN AERIAL WORK. Further description thereof will be omitted in the present application.

As the anti-falling tongue of the steel rail anti-falling device has a sectional profile of a cam structure, preferably of an involute cam structure, when a wearer accidentally falls off, the anti-falling tongue is rotated about the tongue fixture pin, so that the cam structure of the anti-falling tongue is pressed more and more tightly against the T-shaped guide rail with the rotation, thereby forming a system for anti-falling by means of increased friction. As this is known from prior art, reference may be made to the related introduction of the two patents in Background, and further description will be omitted in the present application.

In an embodiment, the anti-falling tongue has knurling at the end pressed against the surface of the T-shaped steel rail. The friction between the anti-falling tongue and the T-shaped guide rail can be further increased.

In an embodiment, the press handles of the two locking members are brought into contact with each other under pressure. That is, the press handles of the two locking members are snap fitted together. As such, the press handles of the two locking members can be pressed with a single hand for unlocking.

The above-mentioned embodiments are only preferred embodiments for fully illustrating the present invention and the protection scope of the present invention is not limited thereto. Equivalent substitutions or changes made by those skilled in the art on the basis of the present invention fall within the protection scope of the present invention. The protection scope of the present invention is defined by the claims.

What is claimed is:

1. A rail type anti-falling safety device, comprising:

a primary bearing block, an anti-falling tongue through-groove being opened on an upper end face of the primary bearing block, an anti-falling tongue pin being provided in the anti-falling tongue through-groove, an anti-falling tongue being provided on the anti-falling tongue pin and being rotatable about the anti-falling tongue pin, the anti-falling tongue being pressed tightly against a surface of a T-shaped steel rail under the action of an elastic element without an external force, the anti-falling tongue having a cam structure at the end pressed against the surface of the T-shaped steel rail and having a hanging loop at the end far from the end pressed against the surface of the T-shaped steel-rail; a first clamping block being provided on a lower end face of the primary bearing block, at least two first rolling wheels being provided on an inner wall of the first clamping block; at least one second rolling wheel being provided on the end face of the primary bearing block far from the anti-falling tongue; two guiding through-grooves being provided on a side wall of the primary bearing block; and a return spring fixture block being provided in the guiding through-groove;

a secondary bearing block, a second clamping block being provided on an upper end face of the secondary bearing block, at least two third rolling wheels being provided on an inner wall of the second clamping block; two insertion arms being provided on a side wall of the secondary bearing block for inserting into the guiding through-groove; a return spring groove being opened on the insertion arm; a return spring being arranged in the return spring groove, one end of the return spring abutting against the return spring fixture block and the other end of the return spring abutting against the side wall of the return spring groove; a locking through-groove being opened at the free end of the insertion arm; and a locking assembly comprising two locking members, the locking members each comprising a stopper block and a press handle that are integrally formed and configured as L-shaped; the connection portion between the stopper block and the press handle being hinged to the free end of the insertion arm; the free end of the stopper block being beveled; the locking member further comprising a locking spring, one end of the locking spring being arranged on the side wall of the locking through-groove and the other end of the locking spring being arranged on the abut block; the stopper block abutting against the primary bearing block under the action of the locking spring without an external force; the stopper block being located in the locking through-groove when the press handle is pressed;

wherein the first clamping block and the second clamping block clamp the T-shaped steel rail jointly.

2. The rail type anti-falling safety device as claimed in claim 1, wherein the elastic element is a tension spring.

3. The rail type anti-falling safety device as claimed in claim 1, wherein the elastic element is a torsion spring through which the anti-falling tongue pin passes.

4. The rail type anti-falling safety device as claimed in claim 1, wherein the cam structure is an involute cam structure.

5. The rail type anti-falling safety device as claimed in claim 1, wherein the press handles of the two locking members are brought into contact with each other under pressure.

* * * * *